US009014923B2

(12) United States Patent
Park

(10) Patent No.: US 9,014,923 B2
(45) Date of Patent: Apr. 21, 2015

(54) POSITION CONTROL APPARATUS AND METHOD FOR WORKING MACHINE OF CONSTRUCTION MACHINERY

(75) Inventor: Kwang Seok Park, Incheon (KR)

(73) Assignee: Doosan Infracore Co., Ltd., Incheon (KR)

( * ) Notice: Subject to any disclaimer, the term of this patent is extended or adjusted under 35 U.S.C. 154(b) by 332 days.

(21) Appl. No.: 13/516,584

(22) PCT Filed: Nov. 5, 2010

(86) PCT No.: PCT/KR2010/007811

§ 371 (c)(1),
(2), (4) Date: Sep. 10, 2012

(87) PCT Pub. No.: WO2011/074783

PCT Pub. Date: Jun. 23, 2011

(65) Prior Publication Data

US 2013/0046447 A1 Feb. 21, 2013

(30) Foreign Application Priority Data

Dec. 18, 2009 (KR) ..... 10-2009-0126545

(51) Int. Cl.

| | |
|---|---|
| ***G06F 7/70*** | (2006.01) |
| ***E02F 9/20*** | (2006.01) |
| ***E02F 3/43*** | (2006.01) |

(52) U.S. Cl.

CPC ..... *E02F 9/2004* (2013.01); *E02F 3/434* (2013.01)

(58) Field of Classification Search

CPC ..... E02F 9/2025; E02F 9/26; E02F 9/2246; E02F 9/2075; E02F 9/2296; E02F 9/2285; F02D 41/021; F02D 2250/18; F02D 41/1497; G05B 2219/45012; B60W 10/06; B60L 11/123; Y02T 10/6217

USPC ..... 701/50, 36; 172/810, 818, 819; 37/348

See application file for complete search history.

(56) References Cited

U.S. PATENT DOCUMENTS 5,359,516 A * 10/1994 Anderson ..... 701/50
5,685,377 A * 11/1997 Arstein et al. ..... 172/2

(Continued)

FOREIGN PATENT DOCUMENTS

JP 10-121522 5/1998
JP 2000-096601 A 4/2000

(Continued)

OTHER PUBLICATIONS

Office Action dated Dec. 23, 2013 issued in Chinese Patent Application No. 201080057036.3, 5 pages.

Search Report dated Jul. 27, 2011, written in Korean with English translation attached for International Application No. PCT/KR2010/007811, filed Nov. 5, 2010, 5 pages.

*Primary Examiner* — Tuan C. To
*Assistant Examiner* — Shardul Patel
(74) *Attorney, Agent, or Firm* — John D. Veldhuis-Kroeze; Westman, Champlin & Koehler, P.A.

(57) ABSTRACT

Disclosed is a position control apparatus for a working machine of a construction machinery, including: a boom driving unit for driving a boom; a bucket driving unit for driving a bucket; a working tool manipulating part for generating a manipulation signal for driving the boom driving unit and the bucket driving unit; a kick-down switch for generating a kick-down signal for lowering a gear stage; and a controller for, if the kick-down signal is generated by the kick-down switch and the manipulation signal is generated by the working tool manipulating part, outputting a control signal to the boom driving unit and the bucket driving unit to move the boom and the bucket to a preset position.

5 Claims, 4 Drawing Sheets

(56) References Cited

U.S. PATENT DOCUMENTS

| | | | | |
|---|---|---|---|---|
| 5,995,893 | A * | 11/1999 | Lee et al. | 701/50 |
| 6,058,342 | A * | 5/2000 | Orbach et al. | 701/50 |
| 6,246,939 | B1 * | 6/2001 | Nozawa | 701/50 |
| 7,289,896 | B2 * | 10/2007 | Ikari | 701/50 |
| 2006/0179690 | A1 | 8/2006 | Ikari | |
| 2009/0240406 | A1 * | 9/2009 | Fukushima et al. | 701/54 |

FOREIGN PATENT DOCUMENTS

| | | | |
|---|---|---|---|
| JP | 2001-271387 | A | 10/2001 |
| JP | 2004-100156 | A | 4/2004 |

* cited by examiner

POSITION CONTROL APPARATUS AND METHOD FOR WORKING MACHINE OF CONSTRUCTION MACHINERY

This application is a Section 371 National Stage Application of International Application No. PCT/KR2010/007811, filed Nov. 5, 2010 and published, not in English, as WO2011/074783 on Jun. 23, 2011.

FIELD OF THE DISCLOSURE

The present disclosure relates to a construction machine such as a wheel loader, and more particularly, to a position control apparatus and a position control method for a working machine of a construction machinery for controlling a position of a working tool such as a boom or a bucket.

BACKGROUND OF THE DISCLOSURE

A construction machine such as a wheel loader is widely used in an operation of conveying and loading earth and sand. In more detail, the wheel loader raises a boom at a position close to a conveying means such as a truck and dumps a bucket containing earth and sand to load the earth and sand on the conveying means. Then, after the bucket is crowded to a horizontal position, a boom is lowered to fill earth and sand in the bucket. Such an operation is repeated a plurality of times until earth and sand is filled in the conveying means. Thus, a wheel loader operator needs to repeatedly perform an operation of raising and lowering the bucket from and to the conveying means.

In recent years, a position control system for, if a bucket lever and a boom lever are operated, maintaining the bucket lever and the boom lever at a manipulated state with an electromagnet, and if the bucket and the boom reach a predetermined position, returning the bucket lever and the boom lever to an original position to automatically move the bucket and the boom to a specific position so that the repeated operation can be easily performed is used.

However, the above-mentioned position control system needs to manipulate the bucket lever first so that the bucket reaches a specific position, and then manipulate the boom lever to move the boom to a specific position. That is, since the position control system needs to individually manipulate the bucket lever and the boom lever, manipulation efficiency is lowered. In addition, since the boom needs to be moved to a specific position only after the bucket is moved to the specific position thereof, an operation cannot be promptly performed.

Moreover, since an electromagnetic system needs to be used to maintain the bucket lever and the boom lever in a manipulated state, manufacturing costs of the construction machine are increased.

The discussion above is merely provided for general background information and is not intended to be used as an aid in determining the scope of the claimed subject matter.

SUMMARY

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The present disclosure has been made in an effort to provide a position control apparatus and a position control method for a working machine of a construction machinery which can reduce manufacturing costs, enhance manipulation efficiency, and improve operation speed.

In order to achieve the above object, the present disclosure provides a position control apparatus for a working machine of a construction machinery, including: a boom driving unit 21 for driving a boom 20; a bucket driving unit 31 for driving a bucket 30; a working tool manipulating part 40 for generating a manipulation signal for driving the boom driving unit 21 and the bucket driving unit 31; a kick-down switch 50 for generating a kick-down signal for lowering a gear stage; and a controller 80 for, if the kick-down signal is generated by the kick-down switch 50 and the manipulation signal is generated by the working tool manipulating part 40, outputting a control signal to the boom driving unit 21 and the bucket driving unit 31 to move the boom 20 and the bucket 30 to a preset position.

The manipulation signal of the working tool manipulating part 40 for moving the boom 20 and the bucket 30 to the preset position may be a boom-down signal.

If a kick-down signal is generated by the kick-down switch 50 and a boom-down signal is not generated by the working tool manipulating part 40, the controller 80 may output the kick-down signal to a transmission control unit 51 to lower a gear stage.

The position control apparatus for a working tool may further include: a boom posture detecting sensor 60 for detecting a posture of the boom 20; and a bucket posture detecting sensor 70 for detecting a posture of the bucket 30. If the kick-down signal and the boom-down signal are input, the controller 80 may drive the boom driving unit 21 and the bucket driving unit 31 until the signals output by the boom posture detecting sensor 60 and the bucket posture detecting sensor 70, respectively are the same as signals for the postures of the boom 20 and the bucket 30 corresponding to the preset position.

The working tool manipulating part 40 may include: a boom manipulating part 41 for generating a manipulation signal for driving the boom 20; and a bucket manipulating part 42 for generating a manipulation signal for driving the bucket 30. The kick-down switch 50 may be installed in the boom manipulating part 41, and the preset position may be a position of the bucket 30 where a bottom surface of the bucket 30 is parallel to the ground surface and a position of the boom 20 where the bottom surface of the bucket 30 is close to the ground surface.

In order to achieve the above object, the present disclosure provides a position control method for a working machine of a construction machinery for controlling positions of a boom 20 and a bucket 30, the method comprising: (a) if a kick-down signal is input, determining whether or not a boom-down signal is input; (b) if the determination result of (a) step shows that the boom-down signal is not input, outputting the kick-down signal to a transmission control unit; and (c) if the determination result of (a) step shows that the boom-down signal is input, moving the boom 20 and the bucket 30 to a preset position without outputting the kick-down signal to the transmission control unit.

According to the present disclosure, since a boom and a bucket can be automatically moved to a preset position by a kick-down switch and a manipulation signal of a working tool manipulating part, an existing system using an electromagnet can be omitted and a separate switch is not required, making it possible to minimize manufacturing costs of a construction machinery.

In particular, since the boom and the bucket can be simultaneously moved, a time for moving the boom and the bucket to a preset position can be reduced, and accordingly, an operation speed of the construction machinery can be improved.

Further, since a boom-down signal is used as a signal for automatically moving the working tool to a preset position together with a kick-down signal, an operator can easily recognize and use an automatic movement signal, and accordingly, manipulation efficiency of the construction machine can be enhanced.

In addition, since a kick-down switch is installed in a boom manipulating part, the kick-down switch and the boom manipulating part can be manipulated by one hand, and accordingly, manipulation efficiency of the construction machine can be further enhanced.

DETAILED DESCRIPTION

Hereinafter, a position control apparatus and a position control method for a working machine of a construction machinery according to exemplary embodiments of the present disclosure will be described in detail.

Figure 1:
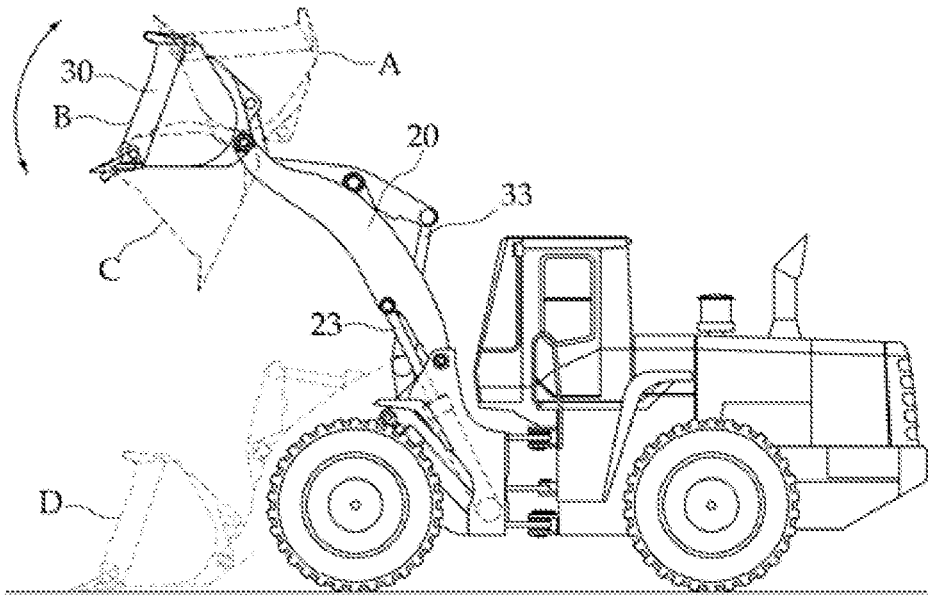
FIG. 1 is a side view schematically illustrating a construction machine to which an exemplary embodiment of the present disclosure is applied.

Referring to FIG. 1, the present disclosure is adapted to control a position of a working tool 20 and 30, and the working tool 20 and 30 includes a boom 20 and a bucket 30. The boom 20 is installed in a body of the construction machine to be rotated upward and downward, and the bucket 30 is installed in the boom 20 to be rotated upward and downward. The construction machine moves to a location close to a conveying means in a posture of the boom 20 and the bucket 30 as illustrated by A of FIG. 1. Thereafter, the bucket 30 is dumped to state C via state B to load earth and sand contained in the bucket 30 on the conveying means. If the earth and sand in the bucket 30 is loaded on the conveying means and the bucket 30 becomes empty, the boom 20 and the bucket 30 are moved to a preset position such as D. The state D is a state where the bottom surface of the bucket 30 is parallel to the ground surface and the bottom surface of the bucket 30 is very close to the ground surface. After the bucket 30 and the boom 20 are moved to the state D, the construction machine is driven forward so that the earth and sand may be filled in the bucket 30 again.

The present disclosure relates to a position control apparatus and a position control method for automatically changing a working tool in the state where the bucket 30 is dumped and the boom 20 is raised as in C to a state (preset position) where the bucket 30 is horizontal and the boom 20 is lowered as in D promptly and easily.

Figure 2:
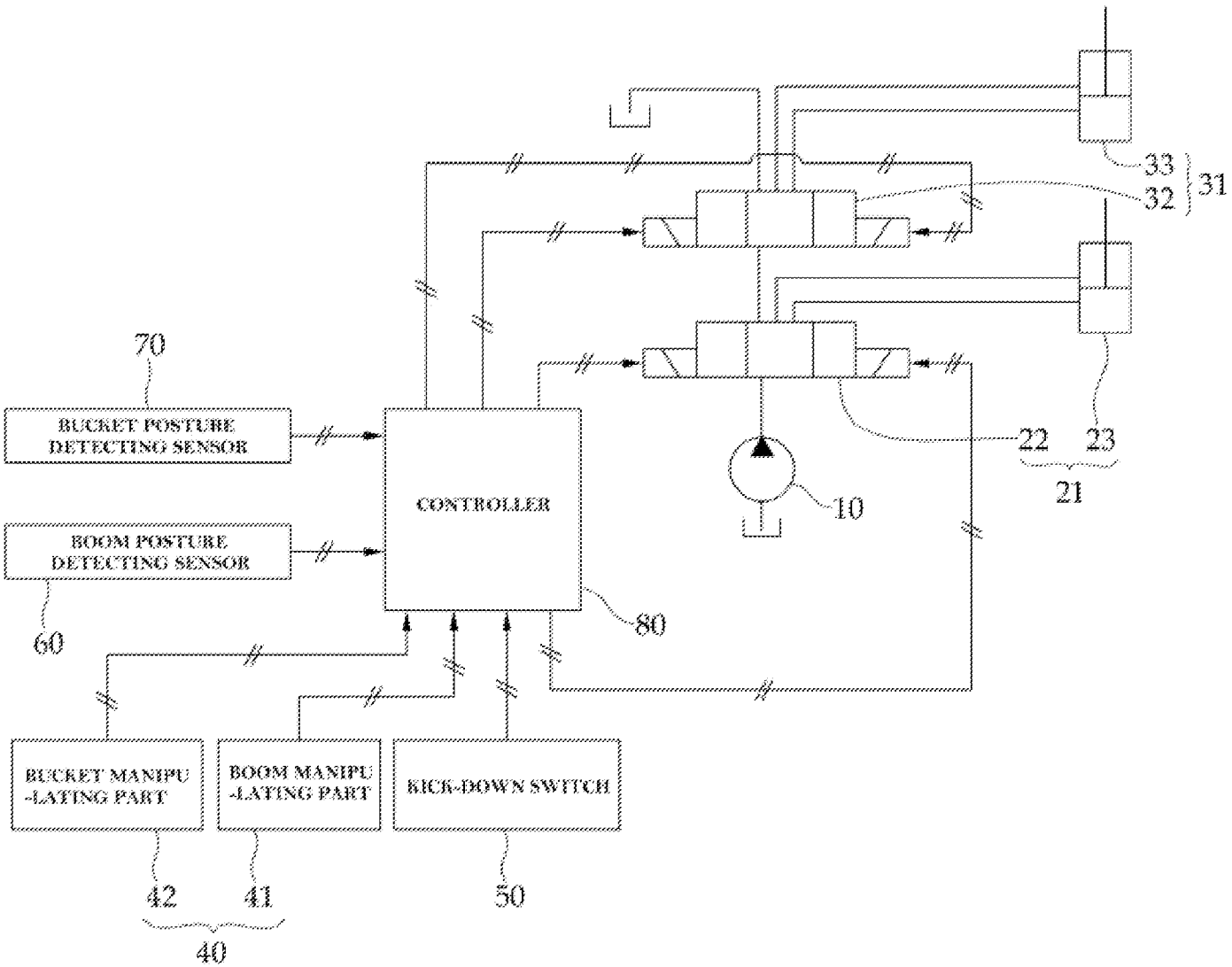
FIG. 2 is a hydraulic circuit diagram schematically illustrating a position control apparatus for a working machine of a construction machinery according to an exemplary embodiment of the present disclosure.
Figure 3:
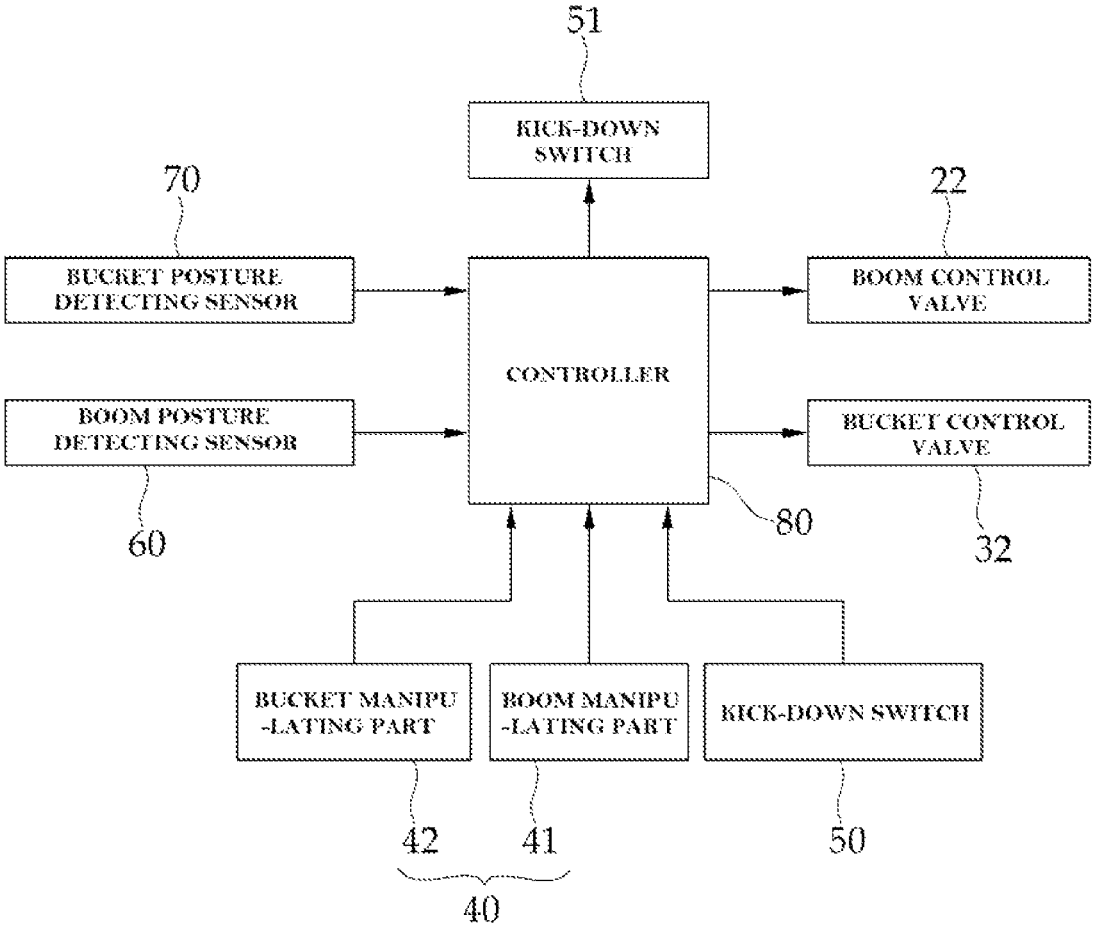
FIG. 3 is a control block diagram of the position control apparatus for a working tool illustrated in FIG. 2.

Referring to FIGS. 1 to 3, the position control apparatus for a working tool of a construction machine according to the exemplary embodiment of the present disclosure includes a boom driving unit 21 for driving the boom 20, a bucket driving unit 31 for driving the bucket 30, a working tool manipulating part 40 for generating a manipulation signal for driving the boom driving unit 21 and the bucket driving unit 31, a kick-down switch 50, a controller 80, a boom posture detecting sensor 60 and a bucket posture detecting sensor 70.

The boom driving unit 21 is adapted to drive the boom 20, and includes a boom control valve 22 for controlling a flow direction of a working fluid discharged from the pump 10, and a boom cylinder 23 to which the working fluid whose a flow direction has been controlled by the boom control valve 22 is supplied such that the boom cylinder 23 is driven. The boom control valve 22 is converted according to an electrical signal transferred from the controller 80 to opposite signal applying parts to expand and contract or stop the boom cylinder 23. Although it is exemplified in the present exemplary embodiment that the boom driving unit 21 includes the boom control valve 22 and the boom cylinder 23, various driving units such as an electric motor may be employed as long as the boom driving unit 21 can drive the boom 20 in response to a control signal of the controller 80.

The bucket driving unit 31 is adapted to drive the bucket 30, and includes a bucket control valve 32 for controlling a flow direction of a working fluid discharged from the pump 10, and a bucket cylinder 33 to which the working fluid whose flow direction has been controlled by the boom control valve 32 is supplied such that the bucket cylinder 33 is driven. The bucket control valve 32 is converted according to an electrical signal transferred from the controller 80 to opposite signal applying parts to expand and contract or stop the bucket cylinder 33. Although it is exemplified in the present exemplary embodiment that the bucket driving unit 31 includes the bucket control valve 32 and the bucket cylinder 33, various driving units such as an electric motor may be employed as long as the bucket driving unit 31 can drive the bucket 30 in response to a control signal of the controller 80.

The working tool manipulating part 40 includes a boom manipulating part 41 for generating a manipulation signal for driving the boom 20, and a bucket manipulating part 42 for generating a manipulation signal for driving the bucket 30. The manipulation signals generated by the boom manipulating part 41 and the bucket manipulating part 42 are output to the controller 80. Then, the controller 80 applies an electrical signal to the bucket control valve 32 and the boom control valve 22 in response to the manipulation signal.

The kick-down switch 50 is adapted to generate an automatic return signal for the working tool 20 and 30 together with the signal generated by the working tool manipulating part 40. In general, the kick-down switch 50 is used when the construction machine is moved forward to fill earth and sand in the bucket in the posture D of FIG. 1. When the construction machine is moved forward to fill earth and sand in the bucket 30, a travel resistance is generated by the bucket 300 whereby a travel speed or power of the construction machine becomes lower than that required by an operator, in which case if the kick-down switch 50 is manipulated, a transmission is adjusted to secure a travel power.

Figure 4:
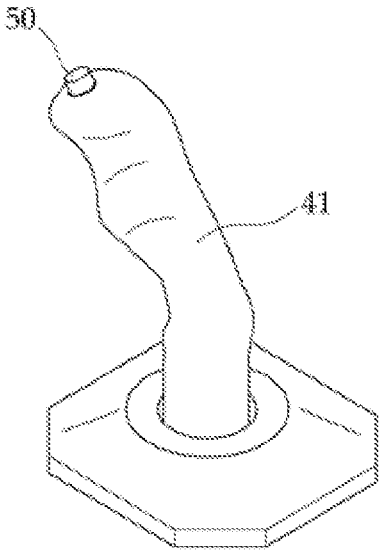
FIG. 4 is a view schematically illustrating a kick-down switch and a boom manipulating part of the position control apparatus for a working tool illustrated in FIG. 2.
Figure 5:
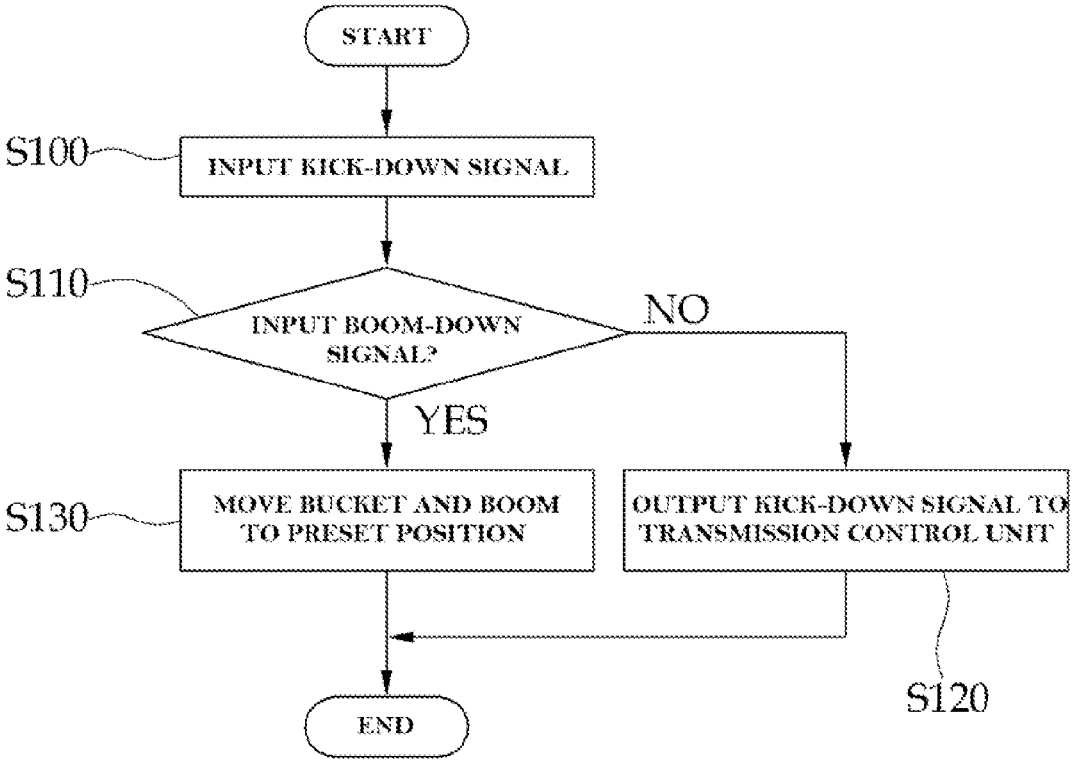
FIG. 5 is a flowchart illustrating a position control method for a working tool of a construction machine according to an exemplary embodiment of the present disclosure.

If an ON signal is generated by the kick-down switch 50 and a boom-down signal is generated by the boom manipulating part 41, the controller 80 moves the boom 20 and the bucket 30 to the state D of FIG. 1. A detailed control process for the above-mentioned operation will be described below. As illustrated in FIG. 4, the kick-down switch 50 is installed in the boom manipulating part 41. In this way, as the boom-down signals of the kick-down switch 50 and the boom manipulating part 41 are used as an automatic return signal of the working tool 20 and 30, a separate switch may not be added and an existing system using an electromagnet may be omitted. Accordingly, the number of parts can be minimized and manufacturing costs of the construction machine can be reduced.

The kick-down switch 50 is adapted to lower a gear stage to increase an RPM of an engine, thereby increasing a flow amount of the pump 10. Thus, while the signal transferred from the kick-down switch 50 is directly input to a transmission control unit 51 according to the related art, the kick-down signal of the kick-down switch 50 is transferred to the controller 80 in the present exemplary embodiment. Then, the controller 80 determines whether the input kick-down signal is an automatic return signal or a signal for lowering a gear stage, and if determining that the input kick-down signal is a signal for lowering a gear stage, the controller 80 transmits the kick-down signal to the transmission control unit 51.

The controller 80 is adapted to control the boom control valve 22, the bucket control valve 32 and the transmission control unit 51 in response to the signals input by the working tool manipulating part 40, the kick-down switch 50, the bucket posture detecting sensor 70 and the boom posture detecting sensor 60. The above-mentioned control process of the controller 80 will be described in detail in a description of a position control method for a working tool which will be described below.

The boom posture detecting sensor 60 is adapted to detect a posture of the boom 20, and may use an angle sensor for measuring a rotation angle of the boom 20 with respect to the body, or a displacement detecting sensor or a gyroscope sensor for detecting a displacement of the boom cylinder 23. The information regarding the position or posture of the boom 20 detected by the boom posture detecting sensor 60 is output to the controller 80.

The bucket posture detecting sensor 70 is adapted to detect a posture of the bucket 30, and may use an angle sensor for measuring a rotation angle of the bucket 30 with respect to the boom 20, or a displacement detecting sensor or a gyroscope sensor for detecting a displacement of the bucket cylinder 33. The information regarding the position or posture of the bucket 30 detected by the bucket posture detecting sensor 70 is output to the controller 80.

Hereinafter, the position control method of a construction machine having the above-mentioned construction will be described in detail.

First, FIG. 1 illustrates a state where the operator dumps the bucket 30 to the state C and all the earth and sand is moved to a conveying means. In this state, the boom 20 and the bucket 30 are supposed to be moved to the state D to fill earth and sand in the bucket 30 again. The movement is performed according to the following steps.

First, if the operator pushes the kick-down switch 50, a kick-down signal is input to the controller 80 (S100). Then, the controller 80 determines whether or not a boom-down signal is input (S110). If the operator pushes only the kick-down switch 50 but fails to generate a boom-down signal, the controller 80 outputs the input kick-down signal to the transmission control unit 51 (S120). Then, the transmission control unit 51 transmits a command for lowering a gear stage to the transmission (not illustrated) to lower the gear stage. Accordingly, an RPM of the engine is increased to increase a discharged flow amount of the pump 10.

Meanwhile, if the operator pushes the kick-down switch 50 and manipulates the boom manipulating part 41 to generate a boom-down signal at the same time, the controller 80 determines that the boom-down signal is an automatic return signal for movement to a preset position (position D) and outputs a control signal to the bucket control valve 32 and the boom control valve 22 so that the bucket 30 and the boom 20 are moved to the preset position (S130).

Then, the bucket control valve 32 is converted to one side, and the working fluid having passed through the bucket control valve 32 contracts the bucket cylinder 33. Accordingly, the bucket 30 is crowded. Further, the boom control valve 22 is also converted to one side, and the working fluid having passed through the boom control valve 22 contracts the boom cylinder 23 and the boom 20 is lowered.

Meanwhile, if the bucket 30 and the boom 20 are driven, a signal for the position and posture of the bucket 30 detected by the bucket posture detecting sensor 70 and a signal for the position and posture of the boom 20 detected by the boom posture detecting sensor 60 are input to the controller 80. Then, the controller 80 determines whether or not the positions of the bucket 30 and the boom 20 are the same as the preset position, in response to the signals input by the bucket posture detecting sensor 70 and the boom posture detecting sensor 60, and if the determination result shows that the positions of the bucket 30 and the boom 20 are the same as the preset position, the controller 80 outputs a control signal to the bucket control valve 32 and the boom control valve 22 to convert the bucket control valve 32 and the boom control valve 22 into a neutral state. Accordingly, the driving operations of the bucket 30 and the boom 20 are stopped in the state D of FIG. 1.

In this case, it is preferable that as the bucket is stopped in a posture where the bottom surface thereof is disposed parallel to the ground surface, the construction equipment for filling earth and sand in the bucket 30 be moved forward immediately.

In this way, as the working tool is automatically moved to a preset position by using an existing kick-down switch and a manipulation signal of the boom manipulating part, a separate switch may not be added and an existing system using an electromagnet may be omitted, significantly reducing manufacturing costs.

In addition, while according to the related art, a bucket manipulating part and a boom manipulating part are sequentially manipulated, and thus a boom is moved after a bucket is completely moved, causing much time to be consumed to move a working tool to a preset position, in the present exemplary embodiment, a bucket and a boom can be moved to a preset position simultaneously only by manipulating a kick-down switch and a boom manipulating part, making it possible to promptly move a working tool and thus improve working speed.

Until now, it has been described that the boom 20 and the bucket 30 are automatically driven to a posture shortly before an excavation operation by using the kick-down switch 50 and the boom manipulating part 41. However, the present disclosure is necessarily limited thereto, but a separate manipulating unit (not shown) may be installed in an operator cage to replace a manipulation of the above-described kick-down switch 50 or replace manipulations of the kick-down switch 50 and the boom manipulating part 41. When the corresponding manipulating unit is replaced by the kick-down switch 50, the kick-down switch 50 is used only to adjust a transmission, and when the corresponding manipulating unit is used together with the boom manipulating part 41, the boom and the bucket will be driven in the above-mentioned posture. In addition, it is apparent that the boom and the bucket can be driven only by the manipulation of the corresponding manipulation unit, and this case also pertains to the scope of the present disclosure. However, when a separate manipulating unit is be installed at another location in the operator cage, or installed separately from the kick-down switch above the boom lever, the separate manipulating unit may hamper the continuity in the manipulation of the operator. Thus, when the kick-down switch installed on an upper surface of the boom manipulating part is used, the kick-down switch and the boom manipulating part can be manipulated by one hand, making it possible to improve the manipulation efficiency of the construction machine.

The present disclosure can be applied to various construction machines including a boom or a bucket as well as a construction machine such as an excavator or a wheel loader.

Although the present disclosure has been described with reference to exemplary and preferred embodiments, workers skilled in the art will recognize that changes may be made in form and detail without departing from the spirit and scope of the disclosure.

The invention claimed is:

1. A position control apparatus for a working machine of a construction machine, comprising: a boom driving unit for driving a boom; a bucket driving unit for driving a bucket; a working tool manipulating part for generating a manipulation signal for driving the boom driving unit and the bucket driving unit; a kick-down switch for generating a kick-down signal for lowering a gear stage; and a controller configured to generate output signals as a combined function of the kick-down signal and the manipulation signal such that, if the kick-down signal is generated by the kick-down switch and the manipulation signal is generated by the working tool manipulating part, the controller outputs a control signal to the boom driving unit and the bucket driving unit to move the boom and the bucket to a preset position, and such that if the kick-down signal is generated by the kick-down switch and the manipulation signal is not generated by the working tool manipulating part, the controller outputs the kick-down signal to a transmission control unit to lower a gear stage.

2. The position control apparatus of claim 1, wherein the manipulation signal of the working tool manipulating part for moving the boom and the bucket to the preset position is a boom-down signal.

3. The position control apparatus of claim 2, further comprising: a boom posture detecting sensor for detecting a posture of the boom; and a bucket posture detecting sensor for detecting a posture of the bucket, wherein if the kick-down signal and the boom-down signal are input, the controller drives the boom driving unit and the bucket driving unit until the signals output by the boom posture detecting sensor and the bucket posture detecting sensor, respectively are the same as signals for the postures of the boom and the bucket corresponding to the preset position.

4. The position control apparatus of claim 2, wherein the working tool manipulating part includes: a boom manipulating part for generating a manipulation signal for driving the boom; and a bucket manipulating part for generating a manipulation signal for driving the bucket, wherein the kick-down switch is installed in the boom manipulating part, and the preset position is a position of the bucket where a bottom surface of the bucket is parallel to the ground surface and a position of the boom where the bottom surface of the bucket is close to the ground surface.

5. A position control apparatus for a working machine of construction machinery, comprising: a boom driving unit for driving a boom; a bucket driving unit for driving a bucket; a working tool manipulating part for generating a manipulation signal for driving the boom driving unit and the bucket driving unit; a manipulation unit for changing the boom and the bucket to a preset posture; and a controller configured to output a control signal to the boom driving unit and the bucket driving unit such that, if a manipulation signal of the manipulation unit is input, the bucket is automatically moved to a position close to the ground surface in parallel to the ground surface by lowering the boom and changing a posture of the bucket; wherein the working tool manipulating part includes a boom manipulating part for generating the manipulation signal for driving the boom, and when the manipulation signal of the manipulation unit is input and a boom-down signal is input by the boom manipulating part, the controller automatically drives the boom and the bucket, and wherein when the manipulation unit is manipulated while the boom-down signal is not input, the controller is a kick-down switch for outputting a transmission adjusting signal to a transmission control unit and is installed on an upper surface of the boom manipulating part to be manipulated together with the boom manipulating part.

* * * * *